US005960804A

United States Patent [19]

Cooper et al.

[11] Patent Number: 5,960,804

[45] Date of Patent: Oct. 5, 1999

[54] CYCLE SELECTION METHOD AND APPARATUS

[75] Inventors: Randall L. Cooper, Newton; Mitchell N. Corbett, Clive; Douglas W. Gardner, Newton, all of Iowa

[73] Assignee: Maytag Corporation, Newton, Iowa

[21] Appl. No.: 08/777,633

[22] Filed: Dec. 31, 1996

Related U.S. Application Data

[62] Division of application No. 08/422,124, Apr. 12, 1995, Pat. No. 5,611,867.

[51] Int. Cl.[6] ..... B08B 3/00

[52] U.S. Cl. ..... 134/56 D; 570/58 D; 68/12.02

[58] Field of Search ..... 134/57 D, 56 D, 134/58 D; 68/12.02

[56] References Cited

U.S. PATENT DOCUMENTS

| | | | |
|---|---|---|---|
| 4,509,543 | 4/1985 | Livingston et al. | 134/57 D |
| 4,735,219 | 4/1988 | Seeland | 134/56 R |
| 5,074,003 | 12/1991 | Manson et al. | 8/159 |
| 5,241,845 | 9/1993 | Ishibashi et al. | 68/12.02 |
| 5,446,531 | 8/1995 | Boyer et al. | 356/72 |
| 5,500,050 | 3/1996 | Chan et al. | 134/18 |
| 5,555,583 | 9/1996 | Berkcan | 8/158 |
| 5,560,060 | 10/1996 | Dausch et al. | 8/158 |
| 5,603,233 | 2/1997 | Erickson et al. | 68/12.02 |
| 5,669,983 | 9/1997 | Cooper et al. | 134/18 |
| 5,681,401 | 10/1997 | Gardner et al. | 134/18 |
| 5,760,493 | 6/1998 | Outcalt et al. | 307/38 |

*Primary Examiner*—Jill Warden
*Assistant Examiner*—Paul J. Lee
*Attorney, Agent, or Firm*—Zarley, Mckee, Thomte, Voorhees & Sease

[57] ABSTRACT

A method of selecting a washing cycle for an intelligent appliance uses several factors to make a cycle selection. The first factor is a combination of the water turbidity, conductivity and temperature as well as the wash arm speed. The other factors are the average of previously selected cycles, the number of times the appliance door has been opened, and the time between wash cycles. The appliance also allows the user to bump up the selected cycle to a higher cycle if the user is unsatisfied with the performance of the appliance. If a failure has occurred with any of the sensors or in the communications routine, the appliance selects the average of previously selected cycles as the wash cycle.

11 Claims, 8 Drawing Sheets

CYCLE SELECTION METHOD AND APPARATUS

This is a divisional of application Ser. No. 08/422,124 filed on Apr. 12, 1995, now U.S. Pat. No. 5,611,867.

BACKGROUND OF THE INVENTION

1. Field of the Invention

The present invention relates to automatic washing machines. More particularly the present invention relates to a method of automatically selecting a dishwashing cycle depending on a number of conditions. While the present invention is described as it applies to automatic dishwashers, it has equal applicability to all cycle controlled washing machines and other cycle controlled systems.

2. Problems in the Art

Prior art dishwashers typically have a number of user selectable dishwashing cycles. The user manually selects one of the cycles depending on what cycle the user feels is appropriate. For example, if the dishes in the dishwasher are not very dirty, the user might select a light washing cycle. On the other hand, if the dishes are very soiled, the user might pick a heavy wash cycle.

Prior art dishwashers have several disadvantages. First, when turning on the dishwasher, the operator may not know how soiled the dishes are without opening up the dishwasher and inspecting the dishes. Even then, visual inspection may not give a good indication of how dirty they are. Some dishes may be dirtier than others, making the user think that the entire load is either dirtier or cleaner than it really is. Also, there is no way for the user to be aware of other factors that affect the selection of the most effective and efficient washing cycle. Such factors include the amount of soil in the water, the presence of detergent in the water after the wash cycle starts, the water temperature, and other factors such as "starving" which is discussed below. In addition, the user may not know or remember how long the dishes have been in the dishwasher. The longer the dishes are in the dishwasher, the harder it is to clean the food off since the food will be dried on the dishes.

Another disadvantage of prior art dishwashers is the degree of complication in operating the dishwasher. When turning on the dishwasher, the user must choose between a number of settings without necessarily knowing which is the best setting. Users not familiar with the dishwasher may not know which setting is the most effective for any set of conditions.

In recent years, manufacturers have been able to make "smart" appliances which have the capability of automatically selecting cycles which were previously selected manually. In a "smart" appliance, the user need only activate a small number of buttons under normal operation. However, even with "smart" appliances, the effectiveness of the appliance is limited to the method used to select cycles. To be effective, an automatic appliance should select cycles based on all relevant operating conditions. In addition, with "smart" dishwashers, if the user is unsatisfied with the performance of the dishwasher, there is no way to improve the performance without manually selecting the wash cycles which defeats the purpose of having a "smart" dishwasher.

OBJECTS OF THE INVENTION

A general object of the present invention is the provision of a cycle selection method for an intelligent appliance.

A further object of the present invention is the provision of a cycle selection method for an intelligent appliance which selects the most appropriate washing cycle for a given set of conditions.

A further object of the present invention is the provision of a cycle selection method that selects a washing cycle based on the water turbidity, conductivity, temperature and wash arm speed.

A further object of the present invention is the provision of a cycle selection method which selects a washing cycle based on the number of times the appliance is opened between cycles and the amount of time elapsed between cycles.

A further object of the present invention is the provision of a cycle selection method which selects a cycle depending on the average of the previously selected cycles.

A further object of the present invention is the provision of a cycle selection method which allows the user to adjust the cycle selection algorithm to choose a higher level washing cycle if the user is unsatisfied with the automatically selected cycles.

A further object of the present invention is the provision of a cycle selection method for an intelligent appliance that selects a default cycle when a failure in the cycle selection system is detected.

These as well as other objects of the present invention will become apparent from the following specification and claims.

SUMMARY OF THE INVENTION

The cycle selection method of the present invention is used to automatically select a washing cycle for an appliance based on various factors. The first factor is a combination of four operating conditions including water turbidity, conductivity, temperature, and wash arm speed. The second factor is the average of the previously selected cycles. The third factor is the number of times the appliance door has been opened since the last cycle. The fourth factor is the amount of time since the last wash cycle. The cycle selection method also allows the user to enter a value which causes the appliance to select a higher level wash cycle from a number of progressively higher level wash cycles. If the appliance controller determines that one of the sensors has failed or the communications routine has failed, the average of the previously selected cycles is selected as the wash cycle.

DETAILED DESCRIPTION OF THE PREFERRED EMBODIMENT

The present invention will be described as it applies to its preferred embodiment. It is not intended that the present invention be limited to the described embodiment. It is intended that the invention cover all alternatives, modifications, and equivalences which may be included within the spirit and scope of the invention.

Figure 1:
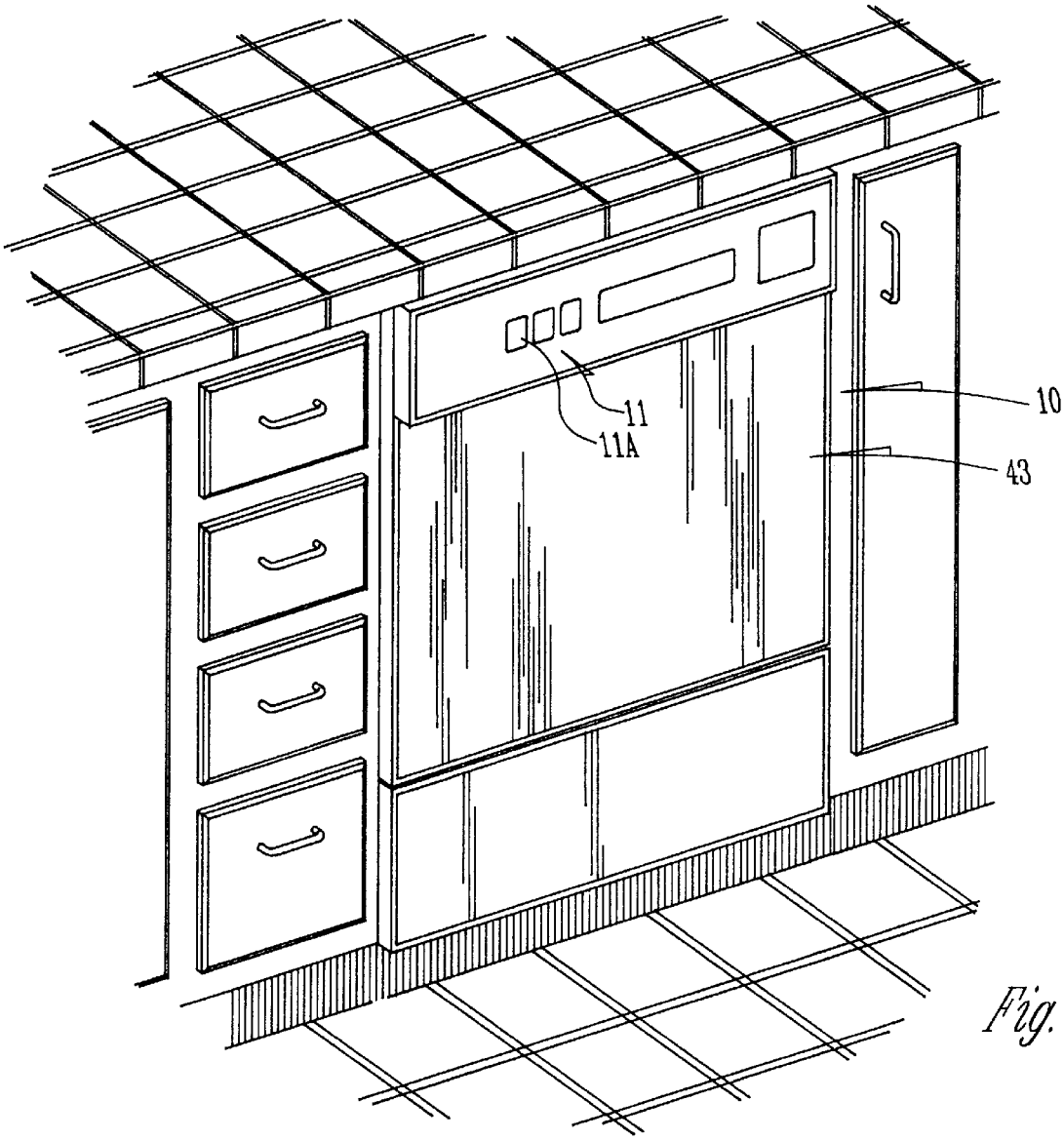
FIG. 1 is an isometric view of the dishwasher of the present invention.

The preferred embodiment of the present invention relates to a "smart" dishwasher 10 as shown in FIG. 1 having a control panel 11 with a button 11*a* which is used to select an automatic washing mode. If the user of the dishwasher 10 selects the automatic mode the dishwasher controls the washing and drying of the dishes by selecting the most appropriate washing cycle depending on the various operating conditions.

Figure 2:
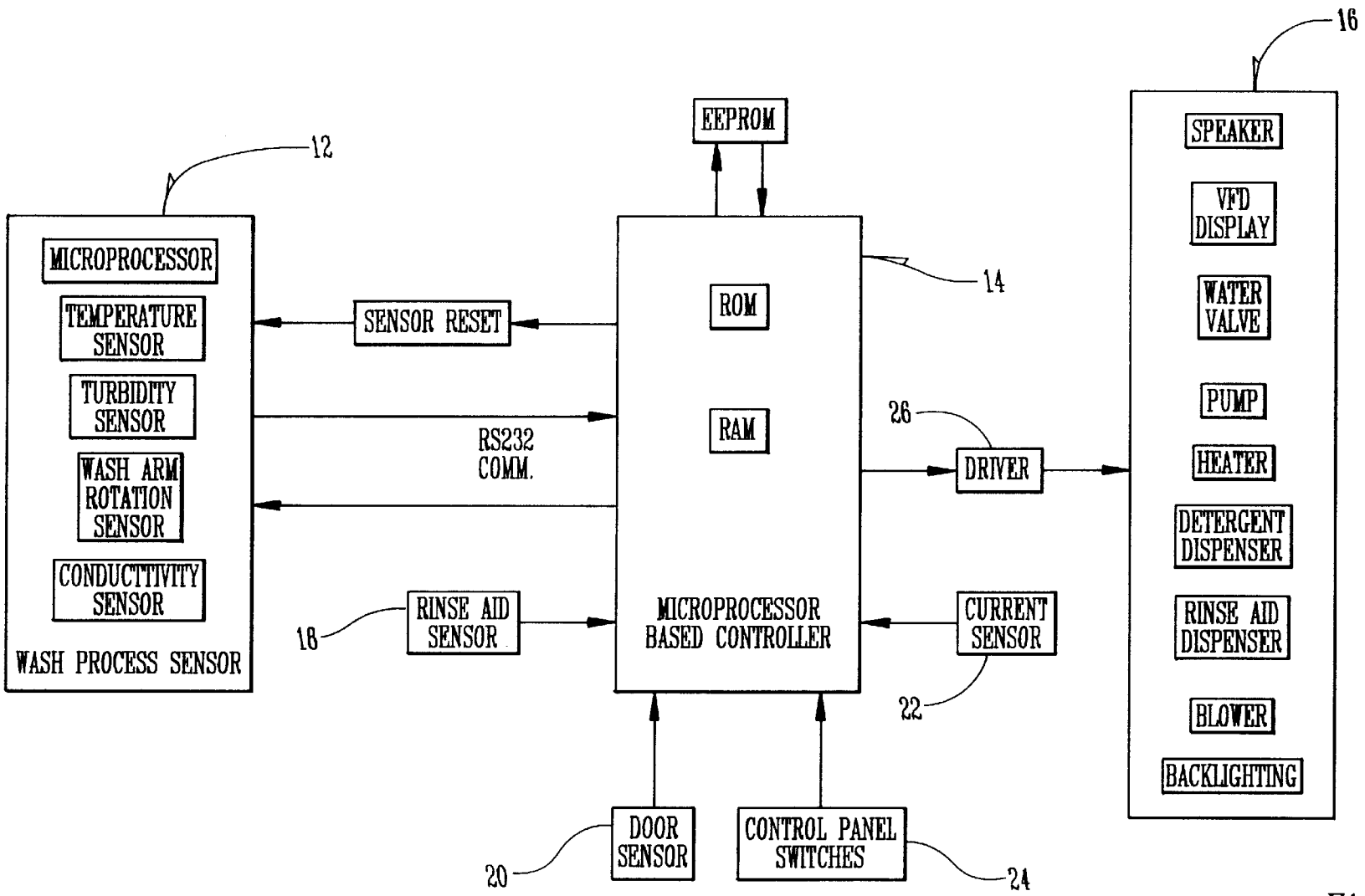
FIG. 2 is a block diagram of the automatic dishwasher of the present invention.

FIG. 2 shows a block diagram of an intelligent dishwasher 10 using the present invention. FIG. 2 includes a wash process sensor block 12, a microprocessor based controller block 14, and an output block 16. Generally, the controller 14 receives inputs from the wash process sensor block 12, the rinse aid sensor 18, the door sensor 20, the current sensor 22, and the control panel switches 24. The controller 14 uses these inputs to control a transistor driver 26 which in turn drives the various components and functions of the dishwasher as shown in the output block 16.

Figure 3:
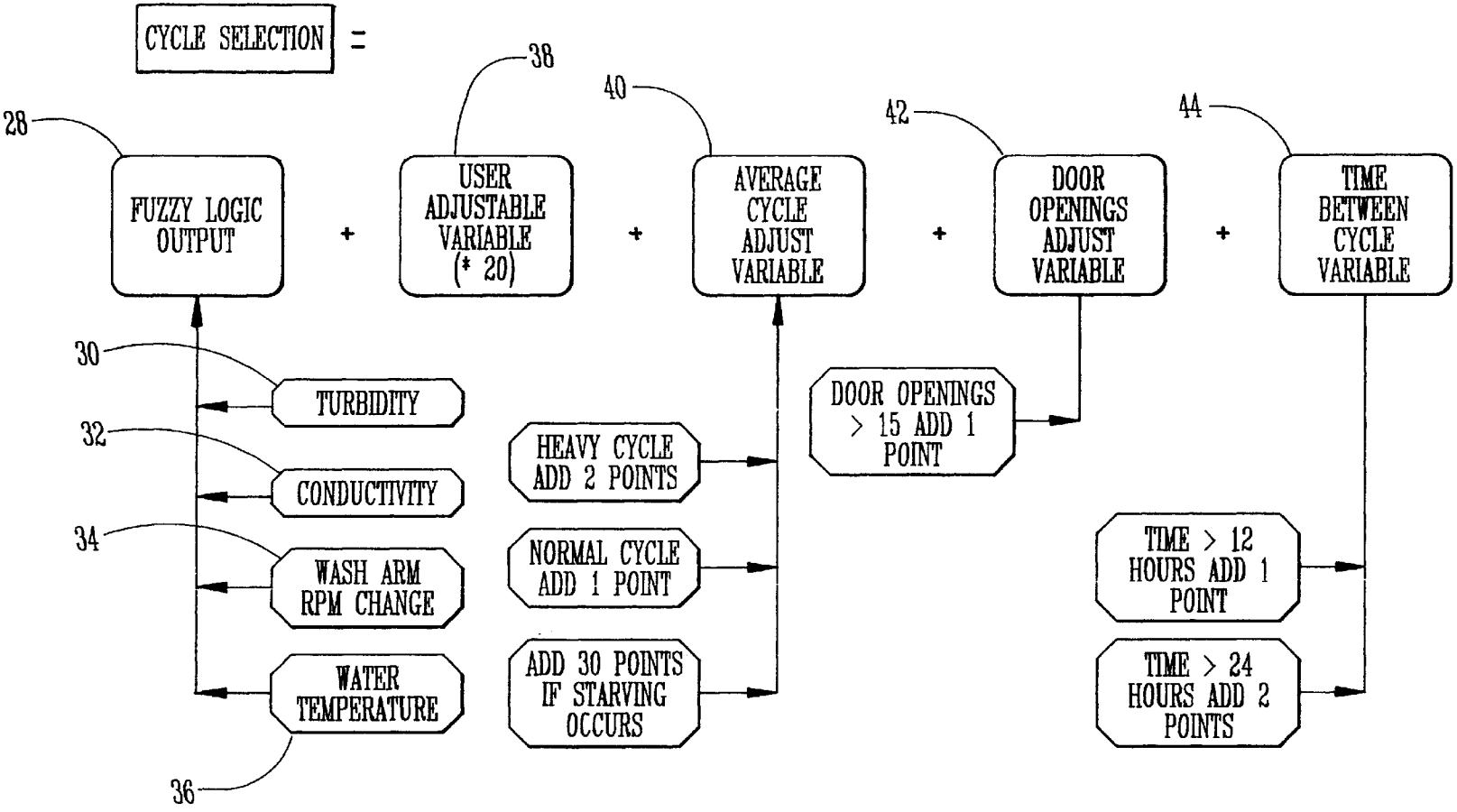
FIG. 3 is a block diagram of the wash cycle selection algorithm.

The controller 14 selects the appropriate wash cycle using a logic algorithm which is stored in its memory. The microprocessor used in the preferred embodiment has a part number MC 68HCO5C9 and is available from Motorola. FIG. 3 shows a block diagram of the controller's cycle selection algorithm. The controller 14 selects a wash cycle depending on the combination of five variables discussed in detail below. The first variable is a fuzzy logic output 28 which is a function of the measured turbidity 30, conductivity 32, wash arm RPM 34, and water temperature 36. The second variable is a user adjustable variable 38 which is constant until the user adjusts it to suit his or her needs. The third variable is the average cycle variable 40 which is simply the average of the previously selected cycles. The fourth variable is the door openings variable 42 which is determined by the number of times the dishwasher door 43 (FIG. 1) is opened between cycles. The last variable is the time between cycles variable 44 which depends on the amount of time elapsed between dishwashing cycles. During the initial wash of the dishwasher 10, the microprocessor based controller 14 uses the cycle selection algorithm shown in FIG. 3 to select the wash cycle.

The fuzzy logic output variable 28 is the main portion of the cycle selection algorithm. The inputs to the fuzzy logic output variable include turbidity 30, conductivity 32, wash arm RPM 34, and water temperature 36. The sensors that provide the controller 14 with these inputs are preferably confined together in a sensor cluster to provide a sensor cluster that senses turbidity, temperature, conductivity, and the wash arm speed. The sensors are attached to a substrate and encapsulated by two plastic housings with a light transmissive and fluid impermeable material. The sensors are, in the embodiment, preferably located in the dishwasher pump housing (not shown). The sensor cluster has a part number APMS-01M and is available through Honeywell. The turbidity sensor measures the soil content in the water which is an indication of the amount of soil on the dishes. The temperature sensor is a thermistor. The conductivity sensor is a sensor that will measure the degree of conductivity within the washing fluids. Dishwasher detergents are an example of a conductive substance when dissolved in water. By using the conductivity sensor, the presence of detergent may be determined. The wash arm RPM sensor is used to measure the rate that the lower wash arm is rotating during a wash cycle. If the rate decreases over a wash cycle, it is an indication of the amount of soil present in the dishwasher. A decrease in wash arm rate may also be an indication of foaming or starving of the pump or of a blocked wash arm. The water temperature sensor simply gives the temperature of the water. The fuzzy logic output generates a number based on the four inputs which represents how soiled the dishes actually are.

Figure 4:
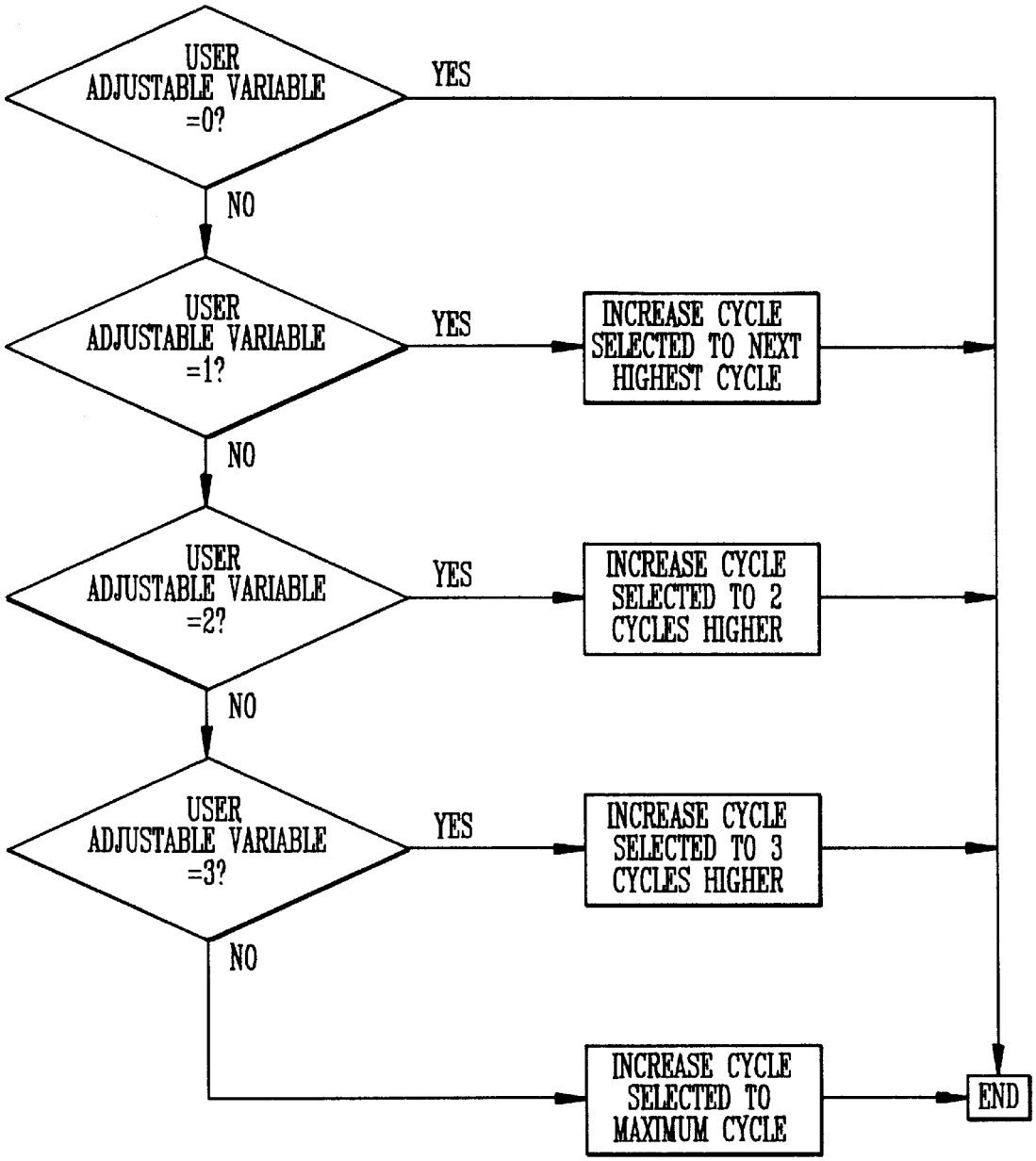
FIG. 4 is a flow chart showing the operation of the user adjustable variable.

The user adjustable variable 38 allows the user to adjust the cycle that the dishwasher 10 would choose by inputting a key sequence on the control panel which will increase controller selected cycle by one to four cycle levels. The automatic dishwasher cycle selection algorithm will normally select a cycle from a number of progressively higher level washing cycles corresponding to no soil, lite soil, lite soil plus, normal soil and heavy soil. These cycles are progressively higher in level since they add water, wash periods and can add heat to increase the water temperature. The user adjustable variable allows the user to bump the selection up to the next higher cycle if the user is unsatisfied with the washability or performance of the dishwasher 10 and it is perceived that the controller 14 is not selecting the proper cycle by itself for satisfactorily cleaning dishes. FIG. 4 is a flow chart showing how the user adjustable variable 38 works. In the example shown, the user adjustable variable is initially at zero which results in no increase of the cycle level selected. If the dishwasher chooses the lite plus cycle and the user selects an adjustable variable of one, the cycle level is increased to the next highest cycle or the normal soil cycle. If the user selects two as the user adjustable variable, the selected cycle is increased two cycle levels to the heavy soil cycle. If the user selects any adjustable variable other than zero through three, the maximum cycle is selected. The user adjustable variable 38 is not intended to be a normal operation of the user. Once the user adjustable variable 38 is selected, it will remain at the selected value until changed again by the user. For each increased cycle selection, the user adjustable variable increases the total of the cycle selection equation of FIG. 3 by 20 points since there are 20 points between each cycle. Of course, any weighting system could be used with the present invention. Also, the user adjustable variable 38 could be separate from the cycle selection algorithm.

The third variable in the cycle selection algorithm is the average cycle adjust variable 40. During the operation of the dishwasher 10, the average cycle chosen by the dishwasher 10 is kept. This average cycle is used to increase the cycle selection of the dishwasher if necessary. This variable is intended to calculate the typical user habits, and will cause the machine to wash a little heavier if a borderline condition occurs between two possible cycle selections. In the preferred embodiment, the average cycle adjust variable 40 works as follows. If the average cycle is a heavy cycle, two points are added to the cycle selection equation. If a normal cycle is the average selected cycle, one point is added to the cycle selection equation.

Thirty points are added to the cycle selection equation if "starving" occurs. "Starving" can occur when there is a lot of material in the water which may cause the dishwasher pump to "starve" or not circulate the water properly. This reduces the effectiveness of the dishwasher.

The fourth variable in the cycle selection algorithm is the door openings adjust variable 42. If the dishwasher door 43 is opened more than fifteen times between washes, one point is added to the cycle selection algorithm. This variable is designed to account for the dryness of food soil on the dishes. For example, if the door 43 has been opened frequently, it can be assumed that the dishes will have varying degrees of dryness. This indicates that the controller 14 may need to choose a slightly heavier cycle if a borderline condition occurs.

The fifth variable in the cycle selection algorithm is the time between cycles variable 44. The dishwasher controller 14 keeps track of the amount of time between wash cycles. The time between cycles variable 44 is intended to capture the potential dryness of the food soil on dishes in the dishwasher 10. The longer that food soil has been on the dishes, the harder it is to remove. Therefore, the longer the dishwasher 10 is not run, the more points will be added to the cycle selection equation. In the preferred embodiment, if the time between wash cycles is greater than 12 hours, one point is added to the cycle selection equation. If the time between wash cycles is greater than 24 hours, two points are added to the cycle selection equation. It is readily apparent that the intent of the instant invention can also be met by utilizing different values for the variables in the equation of FIG. 3.

Figure 5:
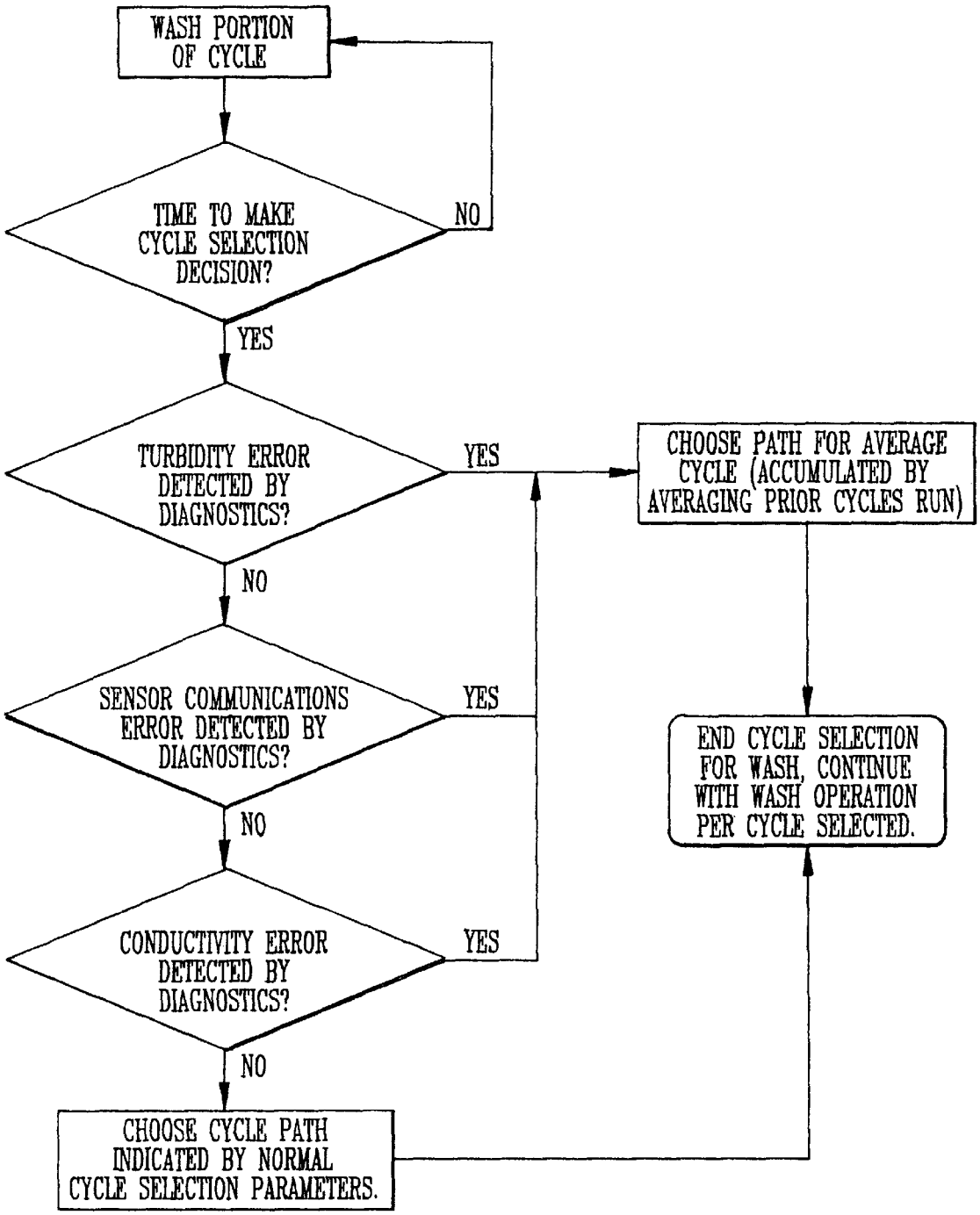
FIG. 5 is a flow chart showing the operation of the error condition cycle decision.
Figure 6:
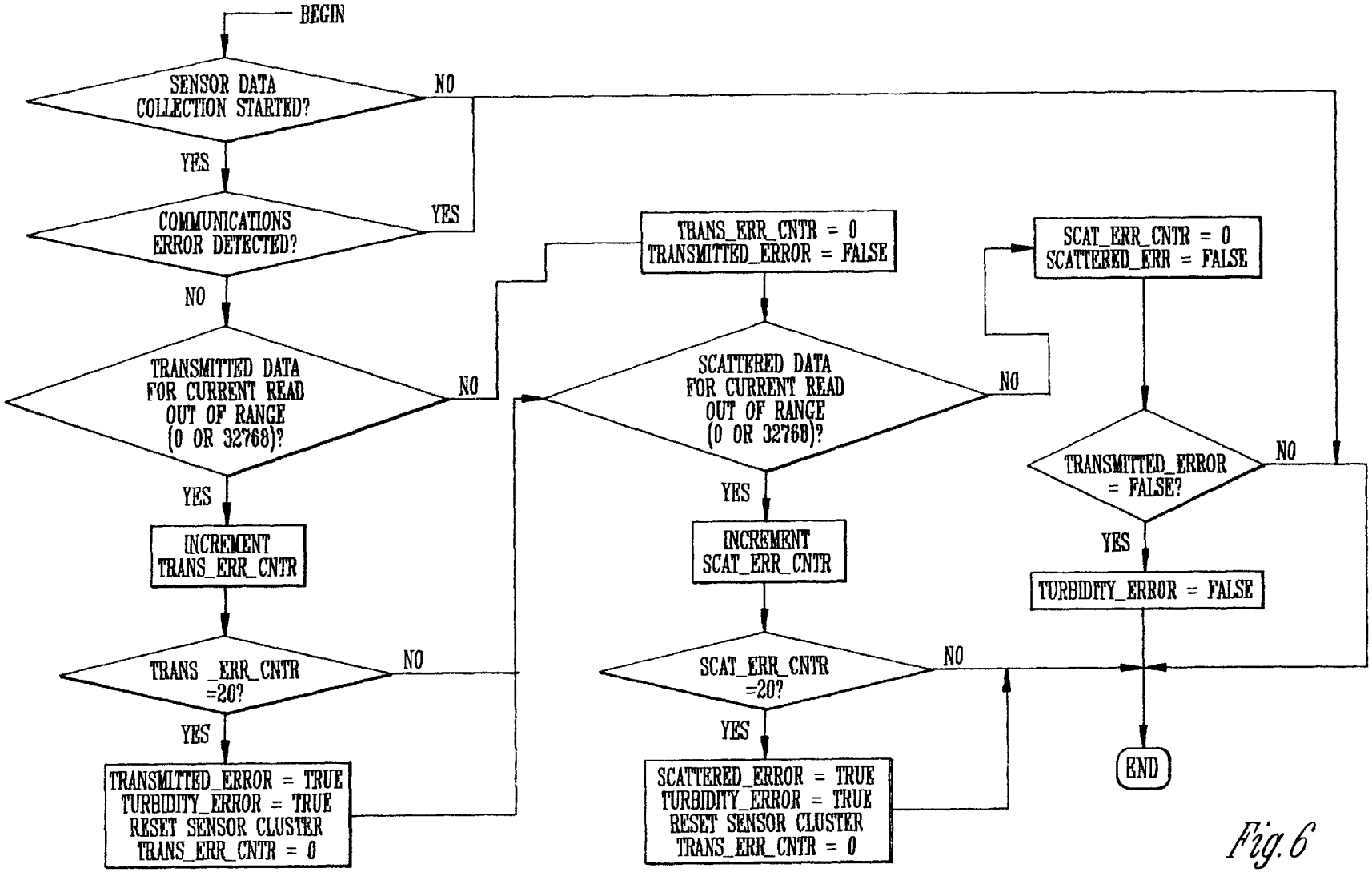
FIG. 6 is a flow chart showing the turbidity error checking sequence.
Figure 7:
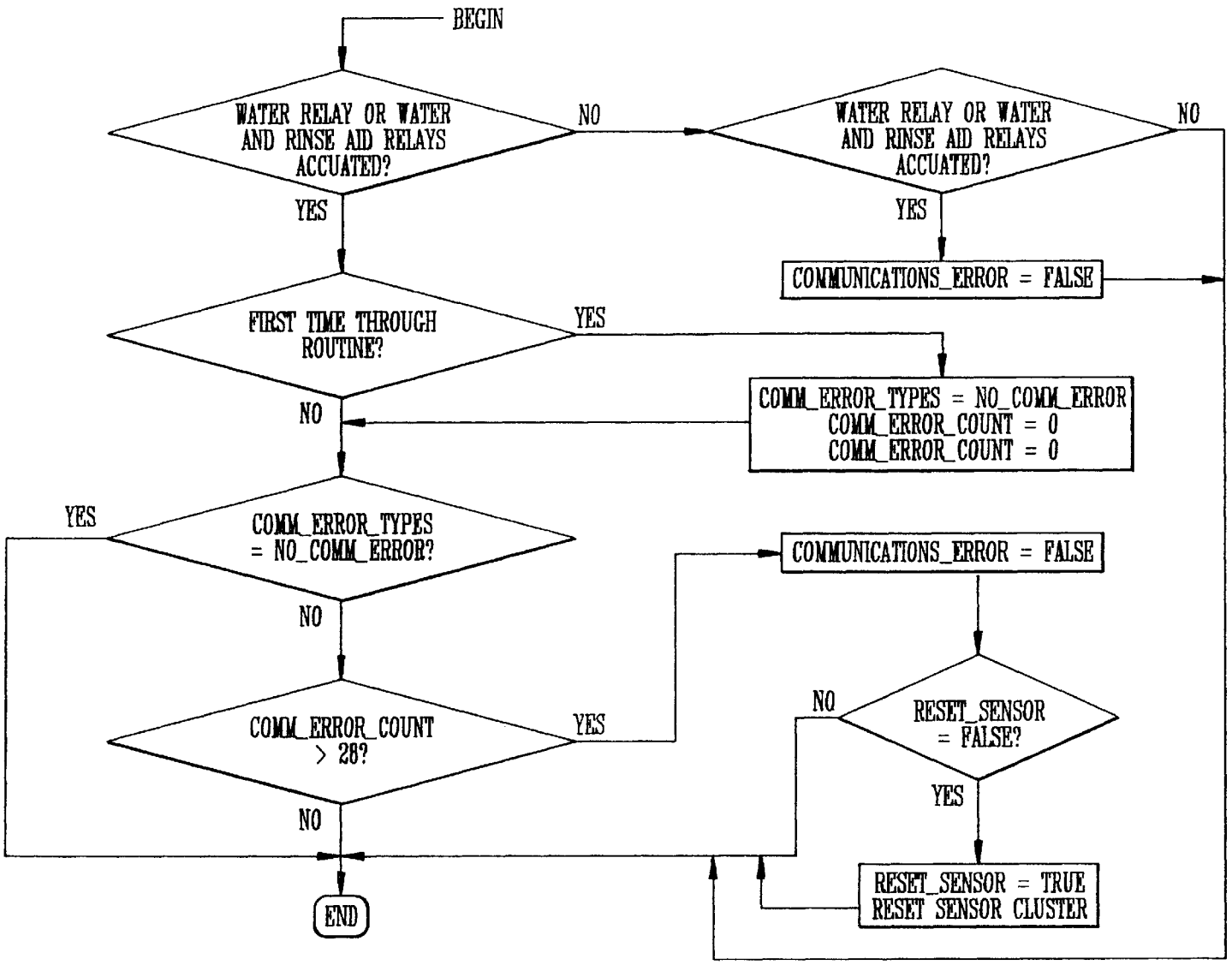
FIG. 7 is a flow chart showing the communications error detection function.
Figure 8:
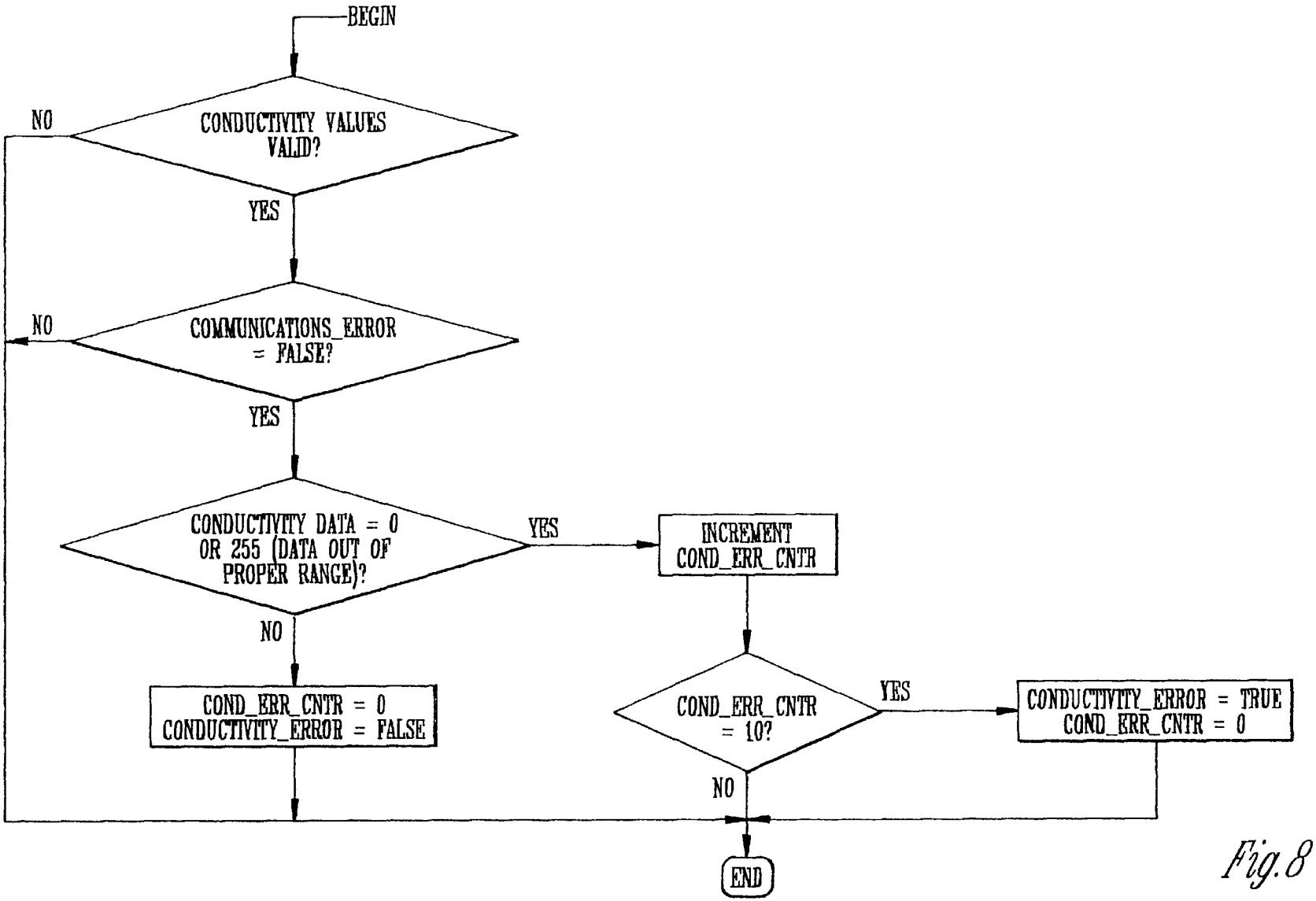
FIG. 8 is a flow chart showing the conductivity error detection function.

The dishwasher controller 14 is also capable of choosing a proper default wash cycle if one of the following occurs: a failed turbidity sensor is detected, a communications failure between the control board and the wash process sensor 12 is detected, or a failed conductivity sensor is detected. The dishwasher keeps an average of the selected cycles. The average cycle is one factor in the cycle selection algorithm as discussed above. The average cycle is also used by the controller 14 as a default cycle if any of the above defaults occur. FIG. 5 is a flow chart showing the error condition cycle decision that the dishwasher 10 uses. When the time comes to make a cycle decision, the dishwasher controller 14 uses diagnostic routines to determine if there is an error with the turbidity sensor, conductivity sensor, or the communication routine. If no errors are detected, the controller 14 chooses a wash cycle using the normal cycle selection parameters. If an error is detected in either of the three areas, the average cycle is chosen as the selected cycle. FIG. 6 is a flow chart showing the turbidity error checking sequence which is used by the controller 14 to detect a turbidity sensor error. This sequence is checked every five seconds while a cycle is running. FIG. 7 is a flow chart showing the communications error detection function. FIG. 8 is a flow chart showing the conductivity error function.

The present invention operates as follows. The user presses a single wash button 11*a* to start the dishwasher 10. The dishwasher 10 begins the initial wash cycle and then makes a selection as to the most appropriate washing cycle. The dishwasher controller 14 uses a cycle selection algorithm to determine the most appropriate cycle. The algorithm uses a fuzzy logic output (which depends on the water turbidity, conductivity and temperature as well as the wash arm speed), the average of the previously selected cycles, the number of times the dishwasher door 43 has been opened since the previous cycle, the amount of time since the last wash cycle, and user input. Using this algorithm, the cycle selected should be the most appropriate cycle for any given set of conditions. If at some point the user is unhappy with the performance of the dishwasher, a series of key strokes can bump-up the selected cycle to the next higher cycle. Thereafter, a cycle higher than the automatically selected cycle will be chosen. If the dishwasher controller 14 detects an error with the turbidity sensor, conductivity sensor, or the communications routine, the controller 14 will select the average selected cycle as a default.

The preferred embodiment of the present invention has been set forth in the drawings and specification, and although specific terms are employed, these are used in a generic or descriptive sense only and are not used for purposes of limitation. Changes in the form and proportion of parts as well as in the substitution of equivalents are contemplated as circumstances may suggest or render expedient without departing from the spirit and scope of the invention as further defined in the following claims.

What is claimed is:

1. A washing machine comprising:

a controller;

a plurality of sensors electrically coupled to the controller for sensing a plurality of operating conditions in the washing machine, the plurality of sensors including a wash arm speed sensor;

a user interface panel electrically coupled to the controller for receiving a user input;

wherein the controller uses the sensed operating conditions and the user input to make a wash cycle selection from a number of progressively higher wash cycle.

2. The washing machine of claim 1 wherein the user input causes the controller to select a higher level wash cycle.

3. The washing machine of claim 1 wherein the plurality of sensors include at least one of: a turbidity sensor, a temperature sensor, a conductivity sensor, and a wash arm speed sensor.

4. A washing machine having a plurality of progressively higher washing cycles, the washing machine comprising:

a plurality of sensors within the washing machine for sensing a plurality of operating conditions in the washing machine, the plurality of sensors including a wash arm speed sensor;

a user interface panel electrically coupled to the controller for receiving a user input;

a fuzzy logic controller for determining the relative dirtiness of wash liquid within the washing machine and automatically selecting one of the progressively higher washing cycles based on the determined relative dirtiness of the wash liquid, wherein the fuzzy logic controller controls the operation of the washing machine based on the selected washing cycle until the selected washing cycle is completed.

5. The washing machine of claim 4 wherein the plurality of sensors include at least one of a turbidity sensor, a temperature sensor, a conductivity sensor, and a wash arm speed sensor.

6. The washing machine of claim 4 wherein the fuzzy logic controller controls the operation of the washing machine based on the selected wash cycle and on user input received by the user interface panel.

7. An intelligent appliance in which a number of possible washing cycles are available from a plurality of progressively higher wash cycles, and in which a number of previous wash cycles have been selected from the plurality of wash cycles, comprising:

a plurality of sensors for sensing a plurality operating conditions in the appliance and generating a first value based on the sensed conditions;

a processor operatively coupled to the plurality of sensors for performing the processing steps of:

determining an average selected cycle from the number of previously selected wash cycles;

generating a second value based on the determined average selected cycle; and making a cycle selection based on the first and second values.

8. A washing machine having a plurality of progressively higher wash cycles comprising:

a controller;

a plurality of sensors electrically coupled to the controller for sensing a plurality of operating conditions in the washing machine;

a user interface panel electrically coupled to the controller for receiving a user input;

the controller being capable of using the sensed operating conditions and the user input to make a wash cycle selection from the number of progressively higher wash cycles;

the controller being capable of determining when one of the sensors has failed, wherein the controller determines an average cycle from previously selected cycles and selects the average cycle if one of the sensors has failed.

9. A washing machine having a plurality of progressively higher washing cycles, the washing machine comprising:

a plurality of sensors within the washing machine for sensing a plurality of operating conditions in the washing machine;

a user interface panel electrically coupled to the controller for receiving a user input;

a controller coupled to the plurality of sensors and being capable, in response to signals from one or more of the plurality of sensors, of determining the relative dirtiness of wash liquid within the washing machine and automatically selecting one of the progressively higher washing cycles based on the determined relative dirtiness of the wash liquid, wherein the controller controls the operation of the washing machine based on the selected washing cycle until the selected washing cycle is completed;

the plurality of sensors including a door sensor for sensing when a door on the washing machine is opened;

the controller being capable of taking into account the number of times the washing machine door has been opened while automatically selecting one of the progressively higher washing cycles.

10. An intelligent appliance in which a number of possible washing cycles are available from a plurality of progressively higher wash cycles, and in which a number of previous wash cycles have been selected from the plurality of wash cycles, comprising:

a processor programmed to keep a record of the number of previous wash cycles which have been selected, determine the average selected cycle from the number of previous wash cycles which have been selected, and make a new cycle selection based on the determined average selected cycle.

11. A washing machine comprising:

a controller;

a plurality of sensors electrically coupled to the controller for sensing a plurality of operating conditions in the washing machine;

a user interface panel electrically coupled to the controller for receiving a user input;

wherein the controller uses the sensed operating conditions and the user input to make a wash cycle selection from a number of progressively higher wash cycle;

a rotating wash arm for spraying water in the washing machine; and a wash arm speed sensor for sensing the speed of the rotating wash arm, wherein the controller uses the sensed speed of the rotating wash to make a wash cycle selection.

* * * * *